United States Patent [19]

Naegeli

[11] 4,010,295

[45] Mar. 1, 1977

[54] PROCESS FOR CONTINUOUSLY BONDING STAPLE FIBERS INTO A STABLE BAND AND STABLE BAND PRODUCED ACCORDING TO THE AFORESAID PROCESS

[75] Inventor: Werner Naegeli, Winterthur, Switzerland

[73] Assignee: Pavena AG, Basel, Switzerland

[22] Filed: June 20, 1972

[21] Appl. No.: 264,622

[30] Foreign Application Priority Data

Dec. 22, 1971 Germany ..... 2163960

[52] U.S. Cl. ..... 428/361; 156/62.2; 428/378

[51] Int. Cl.[2] ..... B32B 19/00; B32B 27/02

[58] Field of Search ..... 156/62.2, 62.6, 296, 156/305; 19/66 R, 66 CC; 57/164; 161/177, 175; 428/361, 378; 264/109, 128

[56] References Cited

UNITED STATES PATENTS 3,511,747 5/1970 Davies ..... 161/175

3,548,462 12/1970 Naegeli ..... 161/177

3,669,778 6/1972 Rasmussen ..... 156/62.2

*Primary Examiner*—Caleb Weston

*Attorney, Agent, or Firm*—Werner W. Kleeman

[57] ABSTRACT

A process for continuously bonding hydrophilic staple fibers into a stable band wherein an excess amount of liquid containing an adhesive distributed therein is applied to a fiber arrangement formed of staple fibers, excess liquid is squeezed off, the fiber arrangement is compacted into a compact band by pressure, and the adhesive in the band is set by feeding the band into or bringing such into contact with a condensing vapor atmosphere.

The stable band produced according to the aforementioned process is manifested by the features that such stable band, compared to a stable band having the same quantity of adhesive and set in dry air, possesses a greater breaking length and a better distribution of adhesive over the cross-section of the stable band.

10 Claims, No Drawings

PROCESS FOR CONTINUOUSLY BONDING STAPLE FIBERS INTO A STABLE BAND AND STABLE BAND PRODUCED ACCORDING TO THE AFORESAID PROCESS

BACKGROUND OF THE INVENTION

The present invention relates to a new and improved process for the continuous bonding of staple fibers into a stable band and to a new and improved stable band produced according to the aforementioned inventive process.

The textile spinning art is already acquainted with the technique of forming stable bands from staple fibers by adhesive bonding. According to this known process a suitable prepared, nontwisted staple fiber arrangement is imbued with an excess of a liquid having distributed therein an adhesive, the excess liquid is squeezed off in a pressure zone while compacting at all sides the staple fiber arrangement into a band, and the staple fibers compacted into the band are transformed into a stable band by setting the adhesive. In the most simple manner the adhesive is set by drying same by means of dry air at temperatures which are conventionally employed in drying techniques. In this regard attention is invited to my U.S. Pat. No. 3,548,462, granted Dec. 22, 1970.

When applying the liquid by means of a liquid applicator device, for instance of the type disclosed in Swiss Pat. No. 426,704 or my U.S. Pat. No. 3,426,389, the staple fibers which are extensively parallely oriented at the fiber arrangement are strongly compacted or compressed together at the pressure zone and between work disks are compressed together to a minimum spacing $x$. Still it is not possible to prevent that, after departure of the fiber band from the pressure zone, such immediately again expands to amount $y$ which can constitute a multiple of the aforementioned value $x$. This cross-sectional expansion of the band is dependent, for instance, upon the fiber material, the degree of crimping of the fibers, the viscosity of the liquid and other similar factors, but in any case even under the most favorable conditions this phenomenon is always present.

This expansion of the fiber band after departure from the pressure zone, particularly in the case of hydrophilic staple fibers, together with the swelling of the fibers which begins following application of the liquid, constitutes a decisive drawback. Such is known to those skilled in the art as the so-called "sandwich-effect" and occurs because of an evacuation of liquid at the outermost cover layer or skin of the band. In other words the liquid introduced into the band and originally uniformly distributed migrates from the cover or outer layer of the band towards the core of the band, internally thereof brings about an increased concentration of liquid, which equally affects the adhesive distributed in the liquid. This sandwich effect is especially then still further intensified if it is simultaneously desired to maintain as short as possible the time between application of the liquid to the staple fibers and drying of the band, whereby the dimensions of the installation can be reduced in a very favorable manner.

After setting of the adhesive or drying there is thus obtained a stable band with only an insufficiently bonded cover or outer layer, so that a subsequent orderly drafting in a single-zone drafting arrangement becomes questionable. Furthermore, owing to breakout of entire parts of the cover layer there can result unusable products having numerous thickened locations.

With the known process, particularly further imparied by the "sandwich-effect", it has been found that the adhesion force of the adhesive distributed in the liquid can only be unsatisfactorily utilized, resulting in considerably economical disadvantages.

SUMMARY OF THE INVENTION

Hence it is a primary object of the present invention to provide an improved method of continuously bonding staple fibers into a stable band and improved stable bands produced according to the aforementioned invention wherein there is effectively and reliably overcome the previously discussed disadvantages.

The process of this invention for the continuous bonding of hydrophilic staple fibers into a stable band overcomes such drawbacks in that following the introduction of an excess amount of liquid having the adhesive distributed therein into a non-twisted fiber arrangement of staple fibers, and after squeezing out the excess liquid from the fiber arrangement and compacting the fibers by application of pressure into a compact band, this band is advantageously subjected to the action of or fed into a condensing vapor atmosphere for the purpose of setting the adhesive.

According to an embodiment of the invention the condensing vapor atmosphere can be overheated or superheated and works at a temperature which is at least 20° C above the boiling point of the introduced liquid.

Furthermore, the time between application of the liquid and supplying of the band into the condensing vapor atmosphere can amount to less than one second.

A stable band fabricated according to the inventive process manifests itself through the presence of a greater breaking length, compared with a stable band composed of the same staple fibers and set in dry air with the same amount of adhesive, and furthermore possesses an improved distribution of adhesive over its crosssection or cross-sectional area.

DETAILED DESCRIPTION OF THE INVENTION

The invention will be still further explained in greater detail in conjunction with the following specific examples.

Starting from a staple fiber band or fiber arrangement delivered from a suitable preparatory machine, for instance a card, an excess amount of liquid is continuously introduced in known manner to the staple fiber band, this liquid containing adhesive distributed therein. In this regard attention is again directed to the previously mentioned United States patents. Owing to squeezing-out of the excess liquid and compacting the fiber arrangement or band there is produced a band containing a predetermined quantity of a still moist, not yet set adhesive, which is immediately subjected to drying. With through-passage velocities in the order of 60–300m/min. and at the same time small dimensions of the installation the time between application of the liquid and the start of drying amounts to less than one second. In this brief time a hydrophilic fiber, for instance raw cotton, obviously cannot swell and there would occur, together with the aforedescribed expansion of the band and after departure of the band from the pressure zone, a pronounced "sandwich-effect". As a result the adhesion or bonding force of the adhesive material would only be insufficiently utilized.

Suppression of this undesirable effect requires a specific drying technique which, according to the concepts of this invention, contemplates bringing into contact, preferably by feeding or supplying the band into a condensing vapor atmosphere. This condensing vapor atmosphere can be produced by evaporation or vaporization and, if desired, subsequent superheating of the liquid introduced into the band. In order to initiate a continuous course of the process, that is for the initial production of the condensing vapor atmosphere the liquid can be atomized, vaporized and if desired overheated. Superheating of the vapor atmosphere has been found to be advantageous for the purpose of increasing the effect, and therefore the condensing vapor atmosphere is preferably maintained at a temperature which is at least 20° C above the boiling point of the introduced liquid.

Upon infeeding the band into a condensing vapor atmosphere there occurs a shock-like or sudden condensation of liquid upon the surface of the band which, as can be readily calculated, can amount to approximately 10 to 15 percent based upon the weight of the band after introduction of the liquid. In order to increase the quantity of condensate at the surface of the band it is possible to maintain the quantity of introduced liquid as large as possible and the temperature of the introduced liquid and the fiber material as low as possible, for instance at room temperature. Furthermore, the band can be additionally sprayed with liquid prior to introduction into the condensing vapor atmosphere, so that the applied quantity of liquid is further increased.

Owing to these measures there are present favorable conditions for a complete swelling of hydrophilic fiber material over the entire cross-section of the band and there is simultaneously realized the best possible utilization of the adhesion or bonding force of the adhesive introduced with the liquid. Migration of the originally homogeneously distributed adhesive into the interior of the band no longer occurs.

After completion of the condensation heating of the band the primary and secondary applied liquid can be again evaporated with simultaneous setting of the adhesive and the stable band, following removal from the vapor atmosphere, can be wound upon a bobbin or the like.

EXAMPLE

A suitably prepared carded raw cotton of American origin with a 1 1/16 inch staple of a weight or strength of 1980 tex (Ne 0.3) is delivered to a liquid applying apparatus of the type for instance disclosed in the previously mentioned Swiss Pat. No. 426,704 or U.S. Pat. No. 3,426,389 and after application of a liquid which is at room temperature and containing in distributed form therein the adhesive, is delivered as a compacted band. Suitable as the applied liquid is a 10 percent aqueous solution of 8 parts Polyprint L 609 and 1 part Polyprint Multus HV, fabricated by the Swiss firm Polygal AG, located at Marstetten, Switzerland. Directly after application of the liquid, that is in less than one second after leaving the impregnation device, the band is continuously subjected to a drying process and after completion of drying is wound upon a bobbin. Drying takes place in dry air at a temperature of 105° C. In the dry condition the stable band is clamped into a tensile tester of the firm Instron Limited, of High Wycombe, Bucks, England and the breaking strength or tear resistance is determined. Recalculation of this breaking strength gave the breaking length, in the form of breaking or tear kilometers (Rkm). In the present case it amounted to 1.3 Rkm. The same stable band was subjected to a 100-fold drafting at a single-zone drafting arrangement, twisted into a yarn Ne 30 and thereafter checked for thickened locations. There were found 360 thickened locations per 500 meters of yarn length.

Instead of drying in dry air a compacted band treated with adhesive in the same manner as previously described was fed into a condensing vapor atmosphere at 150° C and having a vapor content of approximately 90 percent by volume. Here also the band after the drying operation was likewise wound upon a bobbin or the like. Checking out the band at the aforementioned tensile tester and carrying out the necessary calculations resulted in an adherence length of 2.7 Rkm. The thus produced stable band with 100-fold drafting at a single-zone drafting arrangement could not be drafted owing to a much too strong mutual adherence of the cotton fibers. Therefore with the same adhesive mixture the concentration of the aqueous solution was reduced from 10 percent to 4 percent and the trial again repeated under the same conditions. The determined breaking length now was found to be reduced to 1.3 Rkm and the draftability at a single-zone drafting arrangement with 100-fold drafting was again faultlessly established. The yarn checking operation showed only 190 thickened locations per 500 meters yarn length.

A comparison of the above-described results reveals that through a specific drying technique, namely the feeding of the band into a condensing vapor atmosphere, the required quantity of adhesive can be reduced by about 60 percent and with simultaneous maintenance of the homogenity of the adhesive bond during the drying operation there could be realized considerably better yarn qualities. Also the dimensions of the installation remain small owing to the no longer required residence time between application of the liquid into the band and subsequent drying, which is advantageous from the standpoint of the economies of such installation.

Analogous trials carried out for instance with cotton waste, combed cotton, viscose staple fibers and generally with staple fibers, for instance synthetic fibers which have hydrophilic properties, all produced essentially analogous results.

While there is shown and described present preferred embodiments of the invention, it is to be distinctly understood that the invention is not limited thereto but may be otherwise variously embodied and practiced within the scope of the following claims.

ACCORDINGLY, What is claimed is:

1. Process of adhesively bonding hydrophilic staple fibers into a stable band, comprising the steps of introducing into a fiber arrangement composed of staple fibers an excess of a liquid containing an adhesive distributed therein, squeezing-off the excess liquid from the fiber arrangement, compacting the fiber arrangement into a moist compact by application of pressure thereto, contacting the moist band with a condensing vapor atmosphere formed from the liquid introduced into the fiber arrangement, and forming liquid from the condensing vapor atmosphere at the moist band for suppressing a sandwich-effect, and drying the band by evaporating the liquid of the band for setting the adhesive and transforming the band into the stable band.

2. Process for continously bonding hydrophilic staple fibers into a stable band, comprising the steps of introducing into a fiber arrangement composed of staple fibers an excess of liquid containing an adhesive distributed therein, squeezing-off the excess liquid from the fiber arrangement, compacting the fiber arrangement into a moist compact band by application of pressure thereto, supplying the moist band into a condensing vapor atmosphere, condensing liquid from the vapor atmosphere at the band, and then setting the adhesive in the band by drying of the band for transforming the band into the stable band.

3. The process as defined in claim 2, further including the step of introducing the liquid into the fiber arrangement at room temperature and supplying the moist band at said room temperature into said condensing vapor atmosphere.

4. The process as defined in claim 2, including the step of supplying the moist band into the condensing vapor atmosphere controlled to be at a superheated condition at a temperature of at least 20° C above the boiling point of the liquid introduced into said fiber arrangement.

5. The process as defined in claim 2, including the step of supplying the moist band into the condensing vapor atmosphere produced by evaporation and subsequent superheating of the liquid introduced into the band.

6. The process as defined in claim 2, further including the step of additionally spraying the moist band with liquid prior to supplying the band into the condensing vapor atmosphere.

7. The process as defined in claim 2, further including the step of supplying the moist band into the condensing atmosphere initially produced by atomizing, evaporating and superheating of liquid.

8. The process as defined in claim 2, further including the step of controlling the time of throughpassing of the fiber arrangement between application of the liquid and supplying of the band into the condensing vapor atmosphere so as to be less than one second.

9. A stable band produced according to the process of claim 1.

10. The stable band as defined in claim 9, wherein such stable band, compared with a stable band which has been set in dry air with the same quantity of adhesive, possesses a higher breaking length and better distribution of adhesive over the cross-section of the band.

* * * * *